US006363757B1

(12) United States Patent
Yu

(10) Patent No.: US 6,363,757 B1
(45) Date of Patent: Apr. 2, 2002

(54) COMBINATION LOCK PROVIDED WITH MEANS TO PREVENT DISTURBANCE OF A SET SERIES OF NUMBERS USED IN OPENING THE LOCK

(76) Inventor: Chun-Te Yu, No. 253, Sec. 3, Yen-Hi Rd., Fu Shing, Chang Hua Hsien (TW)

( * ) Notice: Subject to any disclaimer, the term of this patent is extended or adjusted under 35 U.S.C. 154(b) by 0 days.

(21) Appl. No.: 09/774,657

(22) Filed: Feb. 1, 2001

(51) Int. Cl.[7] ..... E05B 37/14
(52) U.S. Cl. ..... 70/28; 70/312
(58) Field of Search ..... 70/22, 23, 27–29, 70/312

(56) References Cited

U.S. PATENT DOCUMENTS 1,117,417 A * 11/1914 Meepos ..... 70/29
4,803,856 A * 2/1989 Ling ..... 70/28
4,860,561 A * 8/1989 Hwang ..... 70/28
5,042,277 A * 8/1991 Jenn-Rong ..... 70/28
5,359,867 A * 11/1994 Ling et al. ..... 70/28
5,609,048 A * 3/1997 Ling ..... 70/28
5,765,409 A * 6/1998 Yang ..... 70/28
5,782,113 A * 7/1998 Chen ..... 70/28
5,901,587 A * 5/1999 Chen ..... 70/312 X
5,927,110 A * 7/1999 Yu ..... 70/312 X
6,058,744 A * 5/2000 Ling ..... 70/28
6,082,155 A * 7/2000 Su ..... 70/22
6,202,455 B1 * 3/2001 Su ..... 70/312 X

* cited by examiner

*Primary Examiner*—Lloyd A. Gail
(74) *Attorney, Agent, or Firm*—Harrison & Egbert

(57) ABSTRACT

A combination lock including main body, a series of number wheels and set wheels, a locating piece, a stop piece, a movable lock rod, a push block disposed on the locating piece, a notch disposed on the stop piece, a slide slot located in the main body, an arresting member slidably disposed in the slide slot of the main body, and a push piece disposed on the movable lock rod for pushing the arresting member to return to its original position, thereby preventing the disturbance of a set series of numbers which are used in opening the combination lock.

6 Claims, 7 Drawing Sheets

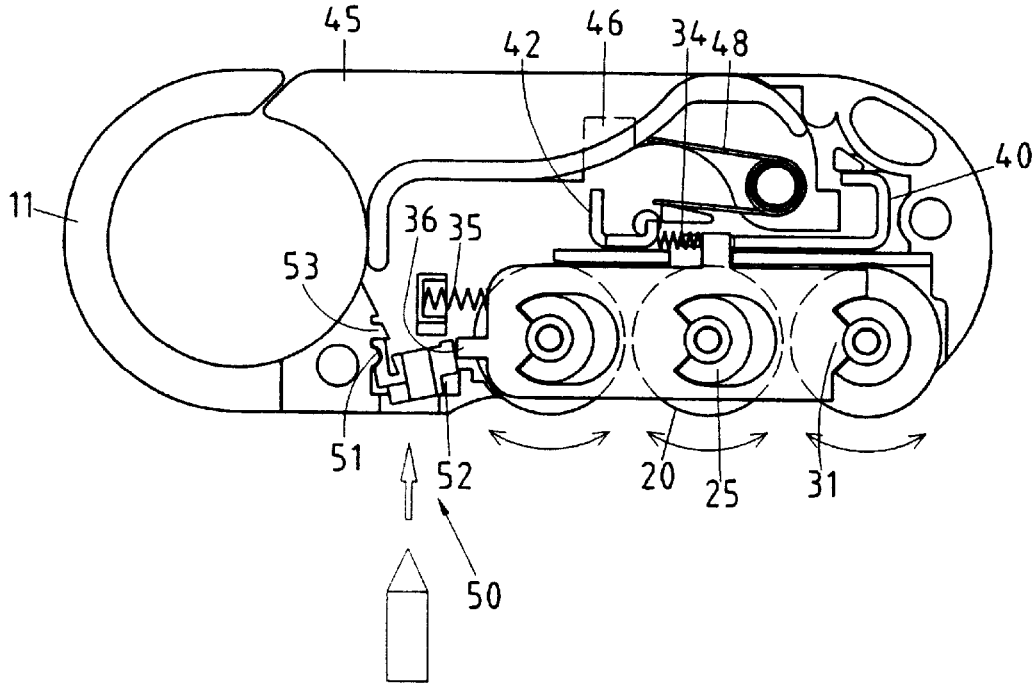
FIG.6-A
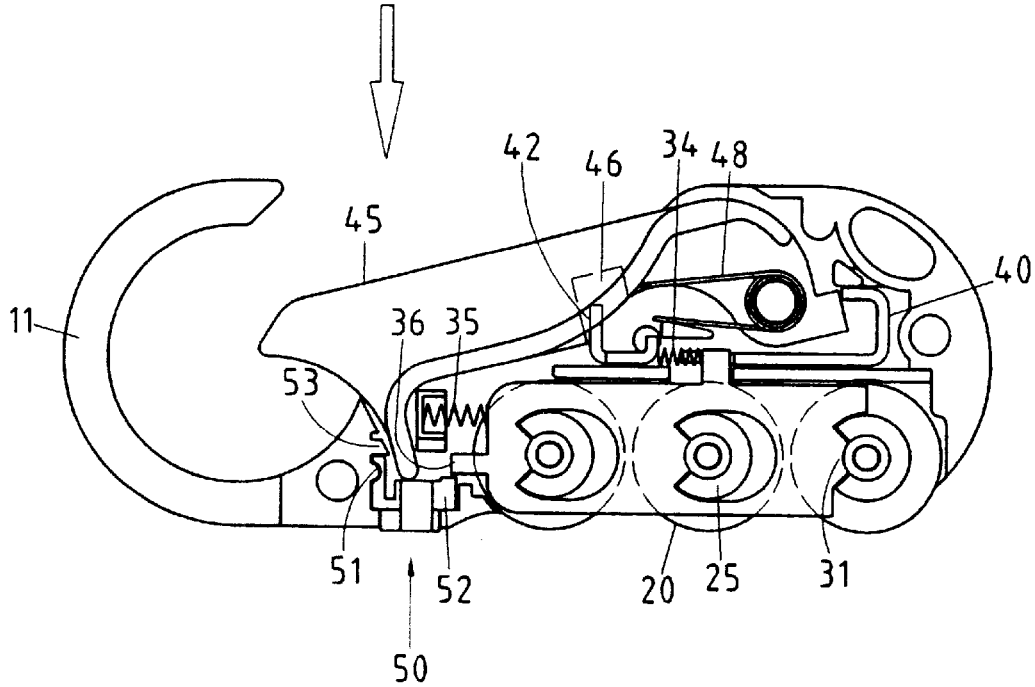
FIG.6-B

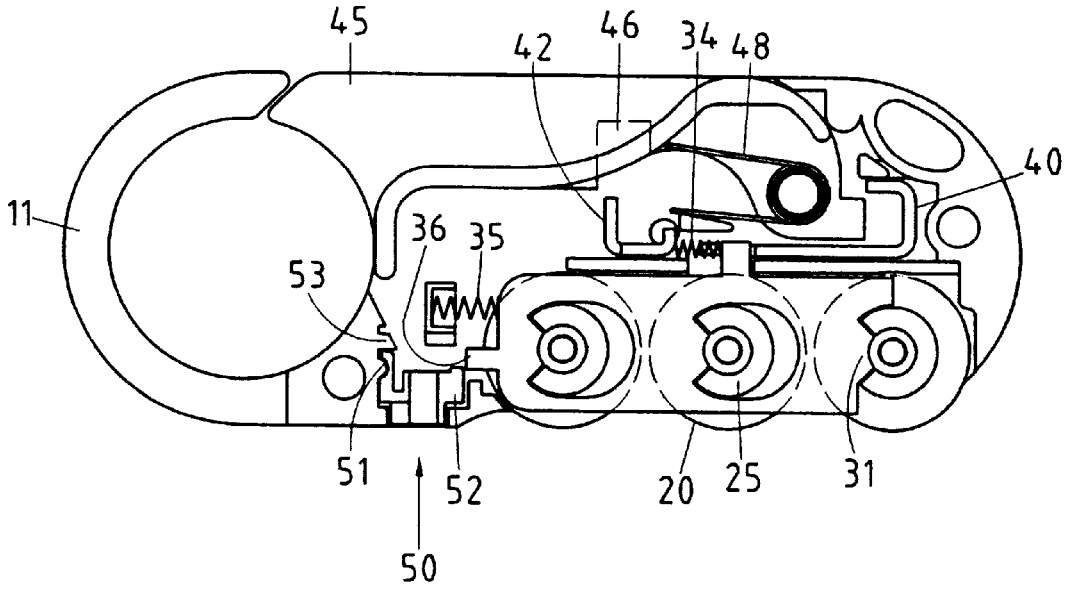
FIG.7-A
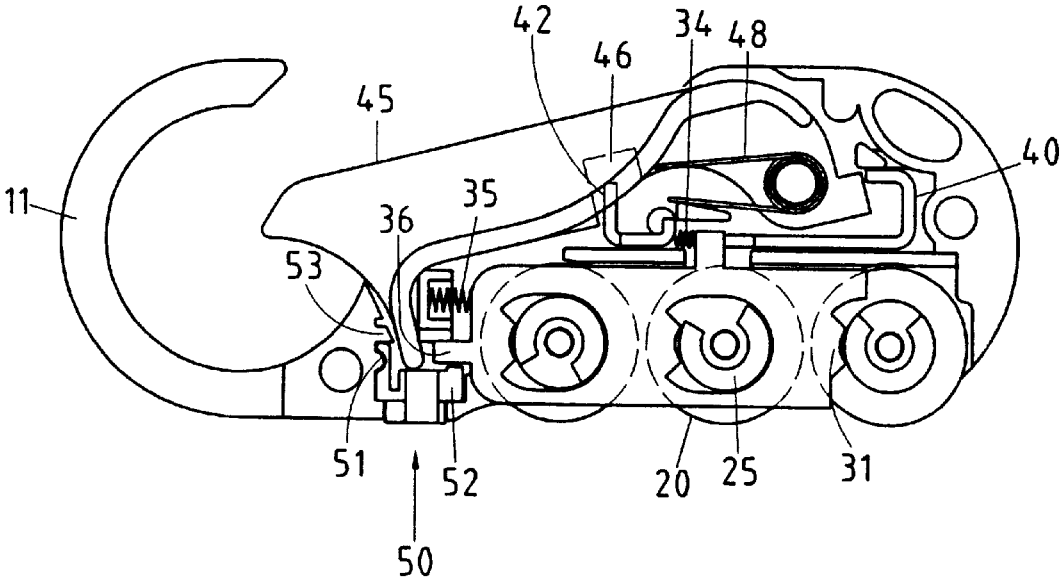
FIG.7-B

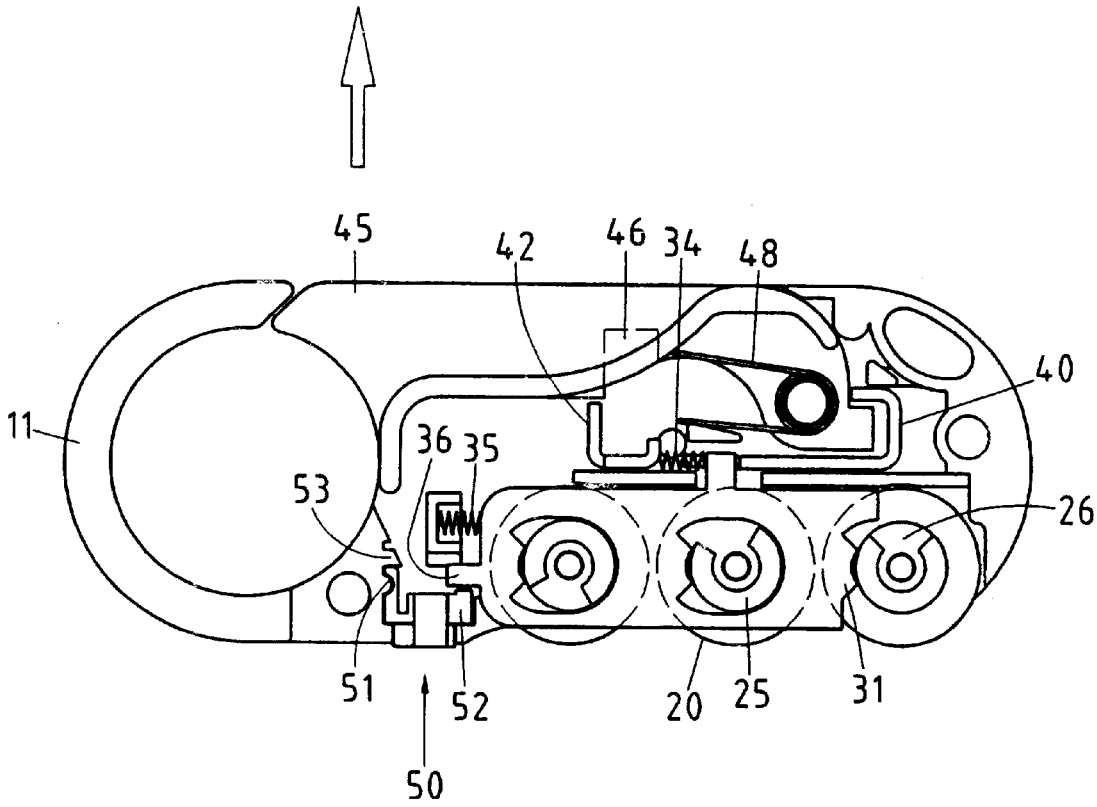
FIG. 7-C

COMBINATION LOCK PROVIDED WITH MEANS TO PREVENT DISTURBANCE OF A SET SERIES OF NUMBERS USED IN OPENING THE LOCK

BACKGROUND OF THE INVENTION

Field of the Invention

The conventional combination lock comprises a mechanism by which the lock is opened by a set series of numbers. The set series of numbers can be easily disturbed so as to result in a failure in the mechanism of the combination lock. There is no effective remedial measure to prevent such a mishap as described above.

BRIEF SUMMARY OF THE INVENTION

The primary objective of the present invention is to provide a combination lock which is free of the deficiency of the prior art combination lock described above.

The combination lock of the present invention comprises a plurality of number wheels, slidable locating pieces, and stop pieces which are provided with a slide slot corresponding to the push block of the locating piece. A recovery spring is disposed in a gap which is located between the slide slot and the push block. As the locating piece is arrested by an arresting member, the set series of numbers can be reset. When the locating piece is not arrested by the arresting member, the locating piece is urged to move upward by the recovery spring to cause the set wheel and the number wheel to turn together,thereby preventing the disturbance of a set series of numbers used in opening the lock.

BRIEF DESCRIPTION OF THE SEVERAL VIEWS OF THE DRAWINGS

FIGS. 6(A–B) show schematic views the present invention at work.

FIGS. 7(A–C) show more schematic views of the present invention at work.

DETAILED DESCRIPTION OF THE INVENTION

Figure 1:
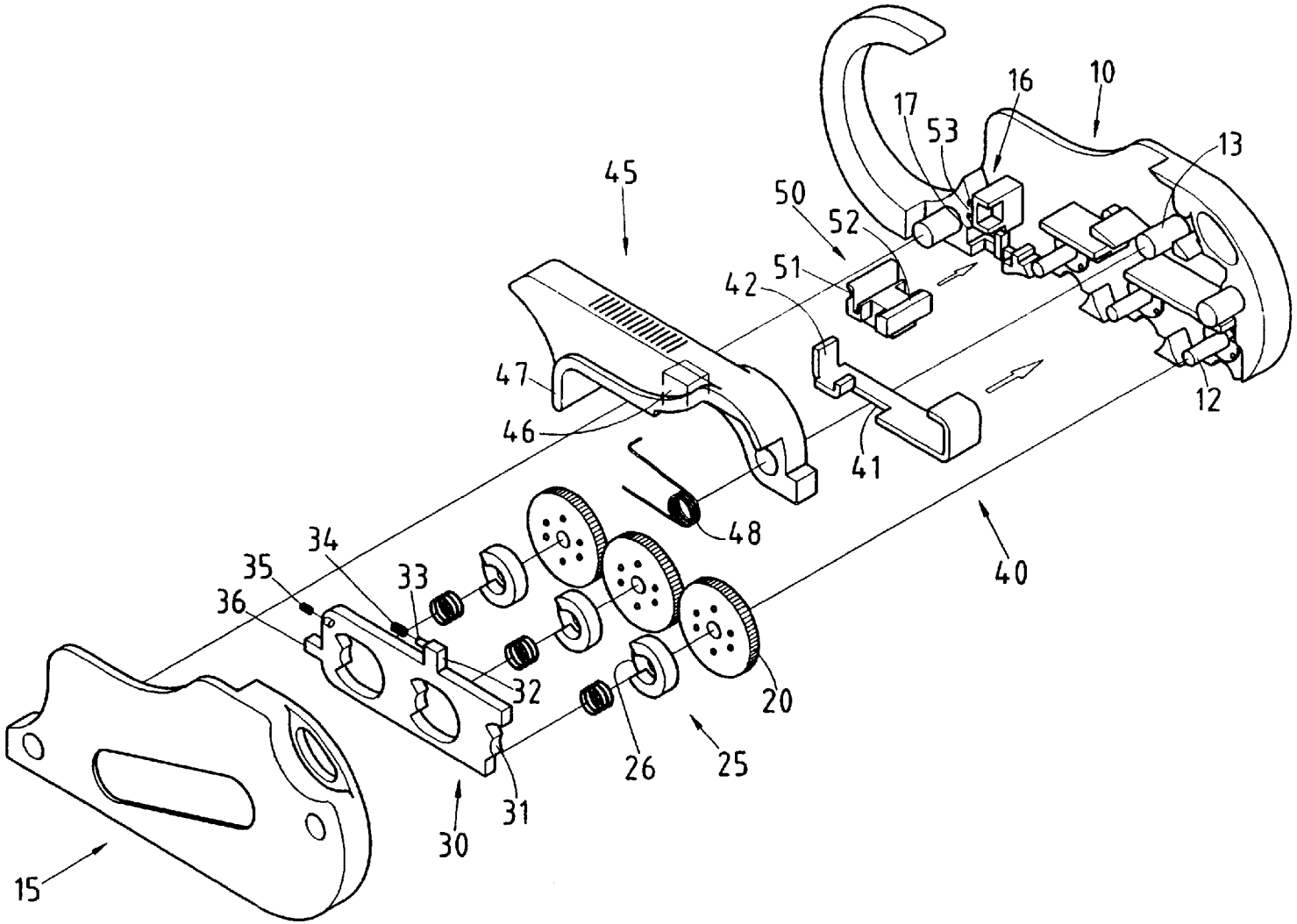
FIG. 1 shows an exploded view of the present invention.
Figure 2:
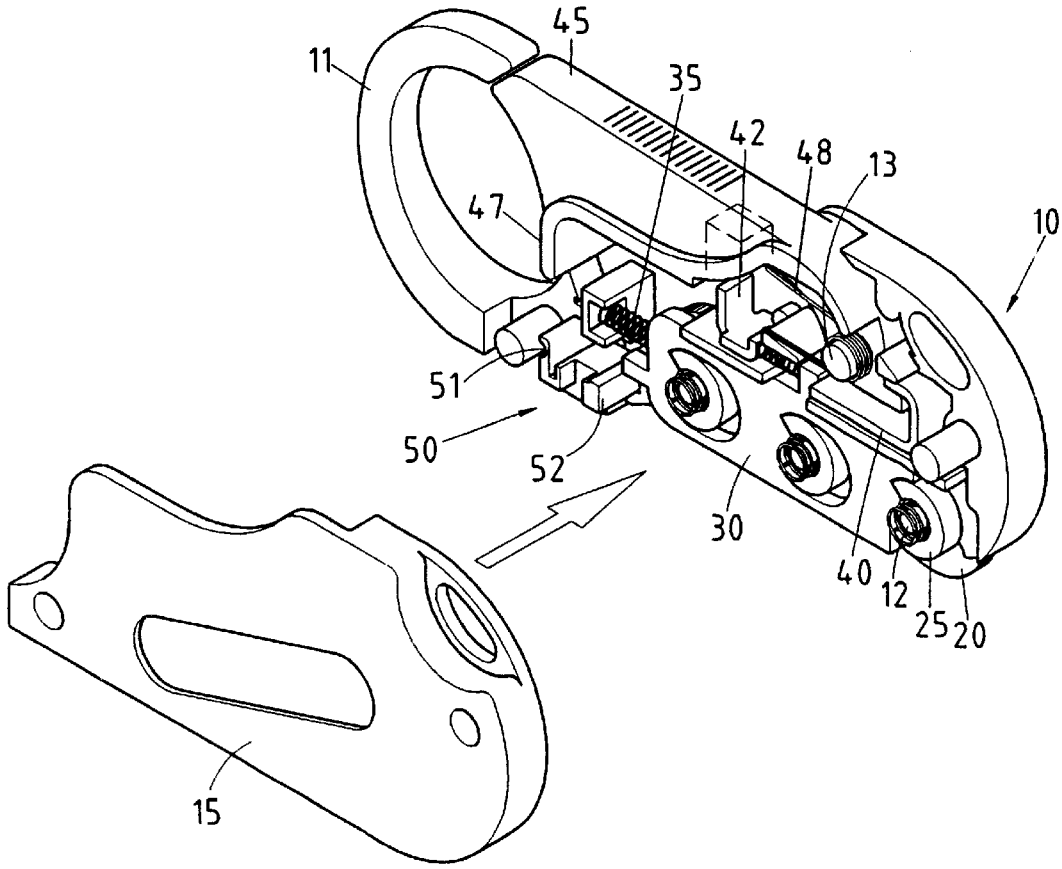
FIG. 2 shows a perspective view of the present invention.
Figure 3:
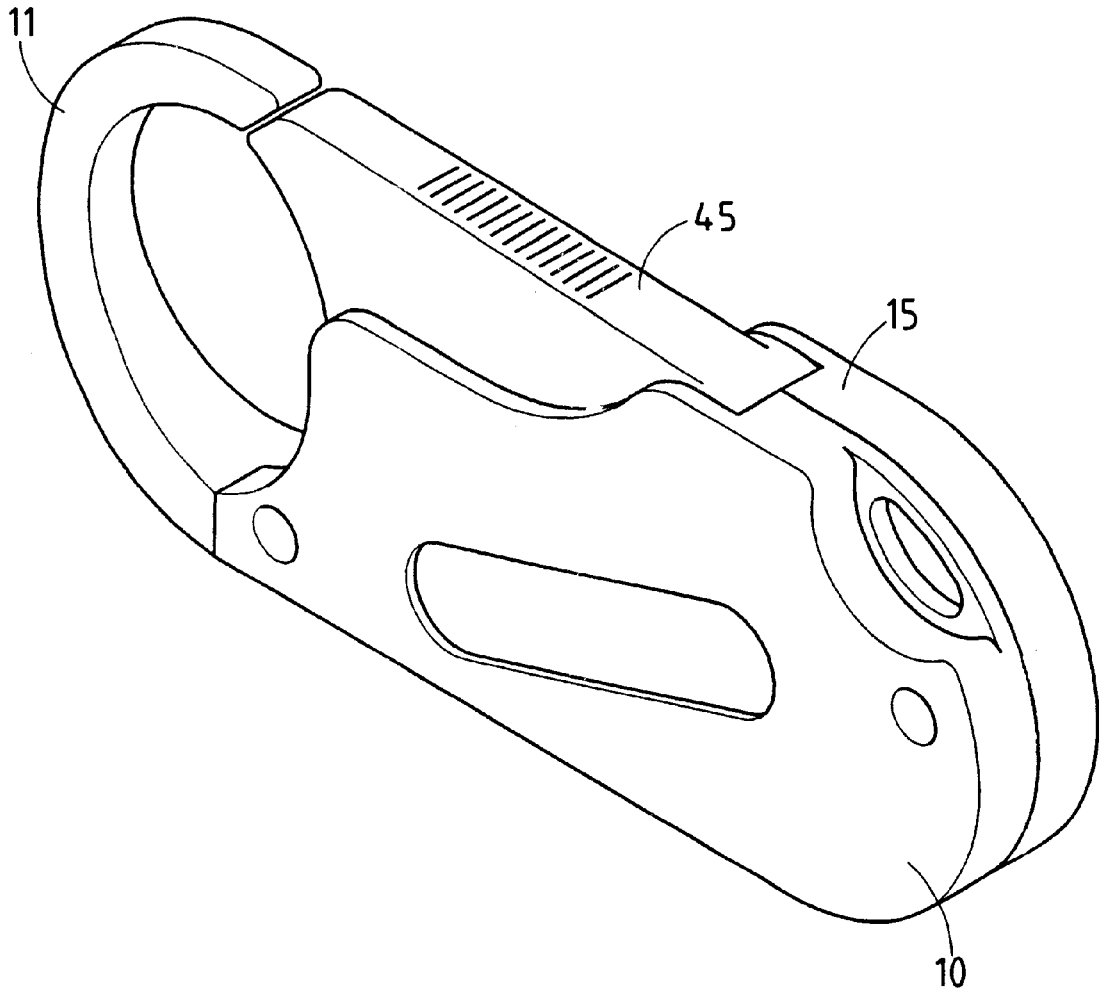
FIG. 3 shows an external view of the present invention.
Figure 4:
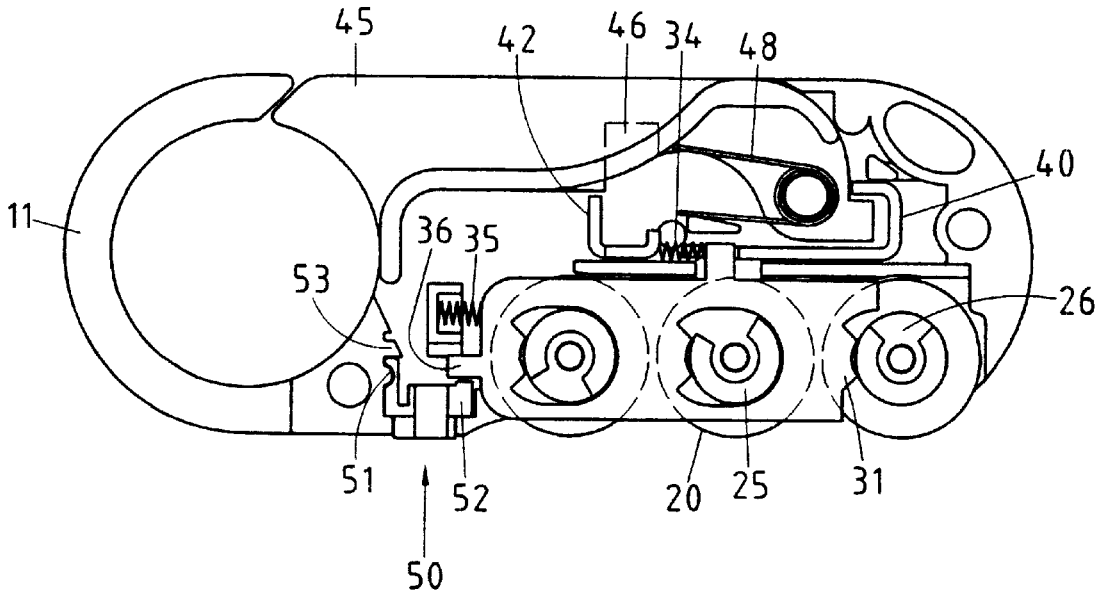
FIG. 4 shows a schematic view of the interior of the present invention.

As shown in FIGS. 1–7C, a combination lock embodied in the present invention comprises a main body 10, a casing 15, a plurality of number wheels 20, a plurality of set wheels 25, a locating piece 30, a stop piece 40, and a movable lock rod 45.

The main body 10 has a fastening lock rod 11 and is provided with a series of pivots 12 for mounting the number wheels 20 and the set wheels 25, which turn synchronously. However, when the set wheels 25 are retained, the number wheels 20 are separately turned. The main body 10 is provided with a pivoting pillar 13 for pivoting the movable lock rod 45 capable of locking or unlocking the fastening lock rod 11. The locating piece 30 is slidably disposed on the set wheels 25 for locating the set wheels 25 and is capable of actuating the stop piece 40. The stop piece 40 is intended to support the rotational action of the movable lock rod 45.

The set wheels 25 are provided with a tapered notch 26. The locating piece 30 is provided with a plurality of tapered blocks 31, which are received in the tapered notches 26 of the set wheels 25. The locating piece 30 is provided with a push block 32 having a protruded pillar 33 for mounting a recovery spring 34 enabling the stop piece 40 to move back and forth. The locating piece 30 is further provided with a protruded block 36. The stop piece 40 is further provided with a cut 41 greater in width than the push block 32, and a projection 42 corresponding to the movable lock rod 45 which is provided with a slot 46 for receiving the projection 42. The movable lock rod 45 is provided with a push piece 47. The movable lock rod 45 and the main body 10 are provided therebetween with a torsion spring 48.

The main body 10 is provided with a slide slot 16 which is in turn provided in the inner wall thereof with a round protuberance 17 and an arresting or stop edge 53. An arresting member 50 is slidably disposed in the slide slot 16. The arresting member 50 is provided with a recess 51 and a press block 52 pressing the protruded block 36 of the locating piece 30. The set wheels 25 and the number wheels 20 are pivoted in the main body 10 such that the set wheels 25 are retained by the locating piece 30. The locating piece 30 is capable of actuating the stop piece 40 so as to retain or release the movable lock rod 45, thereby preventing a set series of numbers from being disturbed by the external force.

Figure 5:
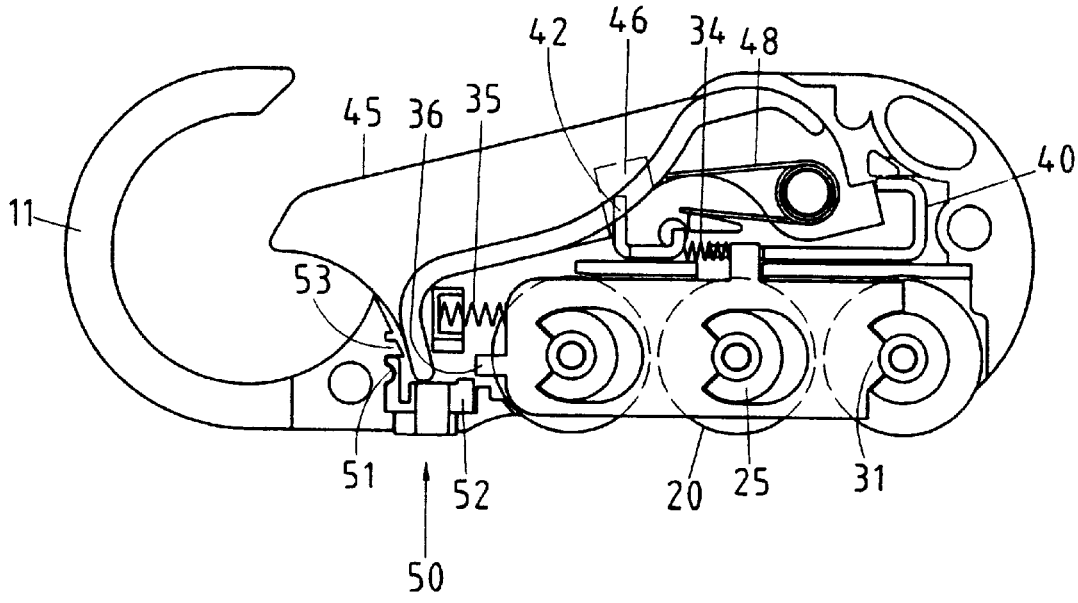
FIG. 5 shows a schematic view of the unlocking action of the present invention.

As a set series of numbers are formed by turning the number wheels 20, the notches 26 of the set wheels 25 correspond in location to the tapered blocks 31 of the locating piece 30. In the meantime, the locating piece 30 is acted on by the spring 35 to move toward the other end, so as to enable the tapered block 31 to be inserted into the notch 26. In light of the push block 32 of the locating piece 30 pressing against the inner edge of the cut 41 of the stop piece 40, the locating piece 30 is capable of actuating the stop piece 40 to displace such that the projection 42 of the stop piece 40 is corresponding to the end of the slot 46 of the movable lock rod 45, thereby enabling the movable lock rod 45 to be pressed and remain in the unlocking state, as shown in FIG. 5.

The set series of numbers may be altered, as shown in FIG. 6. The lock must be first kept in the unlocking state, as shown in FIG. 5; the arresting member 50 is then pushed by a pointed object to move inward such that the round protuberance 17 of the slide slot 16 of the main body 10 is retained in another recess 51 of the arresting member 50, thereby causing the press block 52 of the arresting member 50 to press against the protruded block 36 of the locating piece 30, as shown in FIG. 6A. The locating piece 30 is thus confined to arrest the notch 26 of the set wheels 25. The number wheels 20 can be thus turned to form a new series of numbers. As the movable lock rod 45 is once again pressed, the arresting member 50 is pushed by the push piece 47 of the movable lock rod 45 to return to its original position, as shown in FIG. 6B. As a result, the locating piece 30 is no longer confined. When the number wheels 20 are turned, the set wheels 25 are actuated to turn. The new series of numbers are prevented from being disturbed.

If the set series of numbers are not to be altered, as shown in FIG.7, the number wheels 20 are turned such that the lock is kept in the unlocking state, as shown in FIG. 7A. In light of a gap existing between the push block 32 of the locating piece 30 and the cut 41 of the stop piece 40, the locating piece 30 is not confined, as shown in FIG. 7B. When the number wheels 20 are inadvertently or playfully turned, the set wheels 25 are also displaced, because of the notch 26 and the tapered block 31. As a result, the new series of numbers are not disturbed. As the movable lock rod 45 is released, the stop piece 40 is forced by the recovery force of the recovery spring 34 to return to its original position, as shown in FIG. 7C.

What is claimed is:

1. A combination lock comprising a main body, a casing, a series of number wheels and set wheels, a locating piece, a stop piece, and a movable lock rod, said number wheels and said set wheels being pivoted to said main body, said stop piece being disposed on said locating piece, said movable lock rod being pivoted to said main body such that said movable lock rod is kept in a locking state or unlocking state; wherein said combination lock further comprises:

a push block disposed on said locating piece such that said push block is corresponding in location to said movable lock rod;

a notch disposed on said stop piece such that said notch is wider than said push block, and that a gap is formed between said notch and said push block, and that a recovery spring is disposed in said gap;

a slide slot located in said main body;

an arresting member slidably disposed in said slide slot of said main body and provided at one end with a press block pressing against a protruded block of said locating piece block; and a push piece disposed on said movable lock rod for pushing said arresting member to return to an original position thereof.

2. The combination lock as defined in claim 1, wherein said push block of said locating piece further comprises a protruded pillar for locating said recovery spring.

3. The combination lock as defined in claim 1, wherein said locating piece and said main body are provided with a spring disposed therebetween.

4. The combination lock as defined in claim 1, wherein said stop piece is provided at both ends with a projection corresponding in location to said movable lock rod; wherein said movable lock rod is provided with a slot dimensioned to receive a projection of said stop piece.

5. The combination lock as defined in claim 1, wherein said slide slot of said main body is provided in the inner wall thereof with a round protuberance; wherein said arresting member is provided with a recess for receiving said round protuberance.

6. The combination lock as defined in claim 1, wherein said slide slot of said main body is provided in the inner wall thereof with a stop edge for stopping one side of said arresting member wherein said arresting member can be actuated by a pointed object to move in such a manner that said p press block of said arresting member is received in said slide slot.

* * * * *